United States Patent [19]

Bosch

[11] 4,322,960

[45] Apr. 6, 1982

[54] MACHINE FOR FORMING OF ROTATIONALLY SYMMETRICAL WORKPIECES

[75] Inventor: Walther Bosch, Ostfildern, Fed. Rep. of Germany

[73] Assignee: Bohner & Koehle GmbH & Co., Esslingen am Neckar, Fed. Rep. of Germany

[21] Appl. No.: 96,272

[22] Filed: Nov. 21, 1979

[30] Foreign Application Priority Data

Nov. 28, 1978 [DE] Fed. Rep. of Germany ..... 2851384

[51] Int. Cl.[3] ..... B21D 22/16

[52] U.S. Cl. ..... 72/83; 72/85

[58] Field of Search ..... 72/81, 83, 85, 453.12

[56] References Cited

U.S. PATENT DOCUMENTS

| | | | |
|---|---|---|---|
| 1,836,921 | 12/1931 | Harrison | 72/83 |
| 3,050,023 | 8/1962 | Brown | 72/85 |
| 3,593,552 | 7/1971 | Fraze | 72/83 |
| 3,802,248 | 4/1974 | Ross et al. | 72/453.12 |

*Primary Examiner*—Lowell A. Larson

*Attorney, Agent, or Firm*—Blanchard, Flynn, Thiel, Boutell & Tanis

[57] ABSTRACT

A machine for forming rotationally symmetrical workpieces includes a base on which is mounted a roller head carrier for a roller head, particularly a multi-roller head having for example three shaping rollers which are arranged at an angular spacing of 120°. The base further supports a headstock which carries the tool for the workpiece to be shaped and a pressing tail spindle for a counterholder which is associated with the workpiece for pressing same against the tool. The roller head carrier and the headstock interconnect through a feed drive for driving the shaping rollers along the workpiece by relative movement of the roller head carrier and head stock. One of the roller head carrier and head stock is connected to the base and the other one is movably guided on the base. The roller head carrier projects on the side of the roller head facing the headstock and has a recess which extends longitudinally of the machine. The headstock is disposed in the recess, such that the feed drive on its one side engages the headstock and on its other side engages the roller head carrier. The axes of the roller head, headstock and feed drive coincide.

9 Claims, 3 Drawing Figures

MACHINE FOR FORMING OF ROTATIONALLY SYMMETRICAL WORKPIECES

FIELD OF THE INVENTION

The present invention relates to a machine for forming of rotationally symmetrical workpieces.

BACKGROUND OF THE INVENTION

Conventional machines of this kind include a base on which is mounted a roller head carrier for a roller head, in particular a multi-roller head with, for example, three shaping rollers which are angularly spaced at 120°, a headstock which carries the tool for the workpiece to be shaped and a pressing tail spindle for a counterholder which is associated with the workpiece held by the tool. The roller head carrier and the headstock are movable relative to one another for driving the shaping rollers along the workpiece with the help of a feed drive. One of the roller head carrier and headstock is connected fixedly to the base and the other is connected movably to the base.

In such conventional machines, the headstock and the unit which is formed by the roller head and the roller head carrier are mounted separately from one another and are spaced on the base. Thus, for carrying out the pressing or hydraulic pressing operation, for example the roller head carrier is moved toward the headstock with the help of the feed drive, the feed drive on its one side engaging the roller head carrier in the area of the base and on its other side engaging the base. In such an arrangement, a large tilting moment is applied to the roller head or the roller head carrier during the shaping operation, which tilting moment is determined by the shaping force, namely by the force which is applied by the headstock through the workpiece and the tool to the roller head, and by the vertical distance of the headstock axis from the headstock carrier guideway on the base. Said tilting moment, if large enough, can result in a tilting of the roller head carrier and a bending of the base and furthermore highly stresses the material of the roller head carrier.

Therefore the basic purpose of the present invention is to produce a machine of the above-mentioned type, in which the mentioned disadvantages are overcome, namely in which during the shaping operation tilting moments do not occur.

This purpose is attained inventively by the roller head carrier projecting from the side of the roller head facing the headstock and having a recess which extends in longitudinal direction of the machine. The headstock is arranged in such recess. The feed drive on its one side engages the headstock and on its other side engages the roller head carrier. The axes of the roller head, the headstock and the feed drive coincide.

The headstock and the roller head carrier are thus on the same side of the roller head and are arranged one in the other, wherein only center pulling forces and thus no tilting moments occur. In this manner the roller head carrier is not tilted and the base is not bent. Also, the guideway in the base, for the movable one of the headstock and roller head, is not loaded.

The roller head carrier has advantageously a frame-like structure with two horizontal frame elements which are elongated in the longitudinal direction of the machine. The first of these frame elements faces the base and is supported on same. The second frame element is spaced from the first, wherein between the two frame elements there is arranged the headstock. The two frame elements can thereby be connected fixedly on their end facing the roller head through a vertical frame element which closes off the recess, wherein the feed drive on its one side engages the vertical frame element and on its other side, by penetrating through a hole in the vertical frame element, engages the headstock.

In order that the headstock is located in the recess during the maximum possible shaping, which occurs over the entire length of the tool, it is provided that the recess is longer than the headstock approximately by the length of the tool, such that in the initial position of the machine the roller head is spaced from the end of the tool facing the roller head.

The feed drive can be hydromechanical for achieving great precision and can contain a hydraulic motor, a gearing and a spindle, for example a ball roller spindle. However, it can also be formed, for example, by a hydraulic piston-cylinder-assembly, the cylinder of which is connected to the roller head carrier and the piston rod of which is connected to the headstock. Also an electric drive is possible.

In order to be able to connect the headstock to the base, the roller head carrier or its recess can be laterally open and the headstock, which is disposed in the recess, can be connected to the base through the lateral openings. It is thus advantageous that the headstock projects laterally beyond the roller head carrier and is connected fixedly to the base through cheek members, which extend around the first frame element of the roller head carrier. Such first frame element is guided slidably on the base, such that the roller head carrier is guided movably on the base. Thus in this case, upon operation of the feed drive, the roller head carrier is pulled past the headstock which is stationary on the base.

The two horizontal frame elements and the headstock can individually be platelike and of substantially rectangular cross section, which results in a strong construction at relatively small dimensions.

During the shaping operation the rollers apply a torsion moment onto the workpiece and through same onto the headstock. In order to absorb said torsion moment, it is possible to prevent relative rotation of the headstock and roller head carrier, for example with the help of a wedge guideway, wherein for example the headstock has a guide part on its upper side which faces the second frame part, which guide part engages a guide groove in the second frame element. If the other side of the headstock is fixedly connected to the base, one obtains through this a good absorption of the torsion moment in two areas which are on opposite sides of the axis of the headstock.

BRIEF DESCRIPTION OF THE DRAWINGS

One exemplary embodiment of the invention will now be described in connection with the schematic drawings, in which.

DETAILED DESCRIPTION

Figure 3:
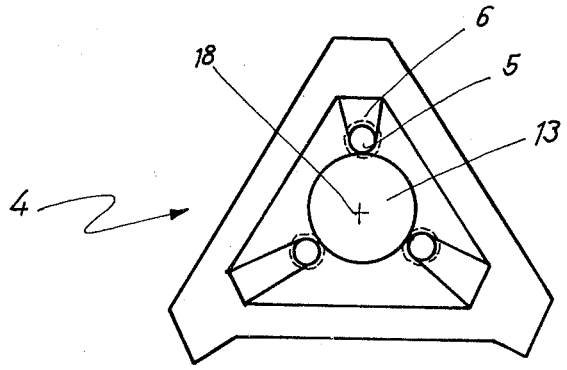
FIG. 3 is a top view of a three-roller head.

The machine which is schematically illustrated in the drawings is used to form rotationally symmetrical workpieces and has a base 1, on the upper side of which a roller head carrier 2 is guided movably with the help of guide rails 3 on the base and guide grooves 4' on the roller head carrier. A roller head 4 is fixedly connected to the one end of the roller head carrier 2, which roller head 4, as can be seen from FIG. 3, has three roller pins 5 which are spaced at an angular distance of 120° and which each serve to receive a shaping roller as schematically shown in broken lines in FIG. 3. Each of said roller pins 5 is positioned on a roller carriage 6, which is only schematically illustrated and which is movable in a radial direction for the control of the feed movement of the associated roller. Details of said roller head are of no interest in the present connection; moreover, such roller heads are conventional and well known.

The machine has further a headstock 7, which is fixedly connected to the base, from which headstock 7 a spindlehead 8 projects toward the roller head 4. The spindlehead 8 carries a tool 9, on which the workpiece 10 to be shaped is mounted.

The base 1 carries finally also a pressing tail spindle 11 for a counterholder 12, which is associated with the workpiece 10 held by the tool 9. Said counterholder 12 is moved prior to the start of the shaping operation through an opening 13 of the roller head 4, until it rests on the bottom 14 of the workpiece 10, which is supposed to be formed with the help of shaping rollers which are mounted on the roller pins 5. In this manner the workpiece 10 is held during forming of its wall on the one side by the tool 9 and on the other side by the counterholder 12. Also the design of the pressing tail spindle 11 has in detail nothing to do with the present invention, so that further description thereof is not needed.

In general, the headstock 7, the roller head 4 and the pressing tail spindle 11 are arranged axially in sequence, wherein the workpiece 10, as mentioned, is held by the tool 9 and the counterholder 12. By moving the roller head 4 or rather the roller head carrier 2, with the help of a feed drive 22, in the direction of the arrow 15, the respectively mounted shaping rollers engage the workpiece 10, wherein the roller head 4 drives over the workpiece 10 and shapes same to the desired length. During the shaping operation the tool 9, and therewith the workpiece 10, are rotated and thereby rotate the counterholder 12. To rotate the tool 9, the headstock 7 includes a conventional rotation drive means (not shown) to spindle 8.

The inventive machine now provides that the roller head carrier 2 projects from the side of the roller head 4 facing the headstock 7, and has a recess 16 which extends longitudinally of the machine, and in which is arranged the headstock 7. The feed drive 22 on its one side engages the headstock 7 and on its other side engages the roller head carrier 2. The axis of the feed drive 22, the axis 17 of the headstock 7 and the axis 18 of the roller head 4 coincide.

The roller head carrier 2 has a framelike structure and has two horizontal frame elements 19 and 20 which are elongated in the longitudinal direction of the machine. The first frame element 19 faces the base 1 and is guided on same. The second frame element 20 of the movable roller head carrier is spaced above the first frame element 19, wherein the headstock 7 is arranged between the two frame elements 19, 20 in the recess 16. As can further be seen from FIG. 2, the two horizontal frame elements 19, 20 and the headstock 7 have a platelike design with a substantially rectangular cross section.

The two frame elements 19, 20 are fixedly connected at their end remote from the roller head 4 by a vertical frame element 21, which closes off the rear end of the recess 16. The feed drive 22 comprises a cylinder 22, for example a hydraulic piston-cylinder-assembly, fixedly connected to the vertical frame element 21 for feed driving the roller head carrier 2. The piston rod 23 of the piston-cylinder assembly 22 engages the headstock 7 by extending slidably through a hole in the vertical frame element 21. By loading the piston-cylinder assembly 22 with a pressure medium, the cylinder thereof pulls the roller head carrier 2 in the direction of arrow 15 since the headstock 7, and thus the piston rod 23, are fixedly connected to the base 1.

In the exemplary embodiment illustrated in the drawings, a centrally arranged piston-cylinder-assembly is provided as a feed drive 22. Of course several such assemblies can engage on one side the roller head carrier 2 and on the other side the headstock 7. These assemblies must, however, be arranged so symmetrically that their resultant coincides with the axes 17 or 18 of the headstock 7 and the roller head 4. In other words, in this case the above-mentioned axis of the feed drive is to be understood as the resultant of the several piston-cylinder assemblies. The feed drive can also be formed easily by a hydromechanical spindle drive, for example with a ball roller spindle of the like. An electric drive is also possible.

Figure 1:
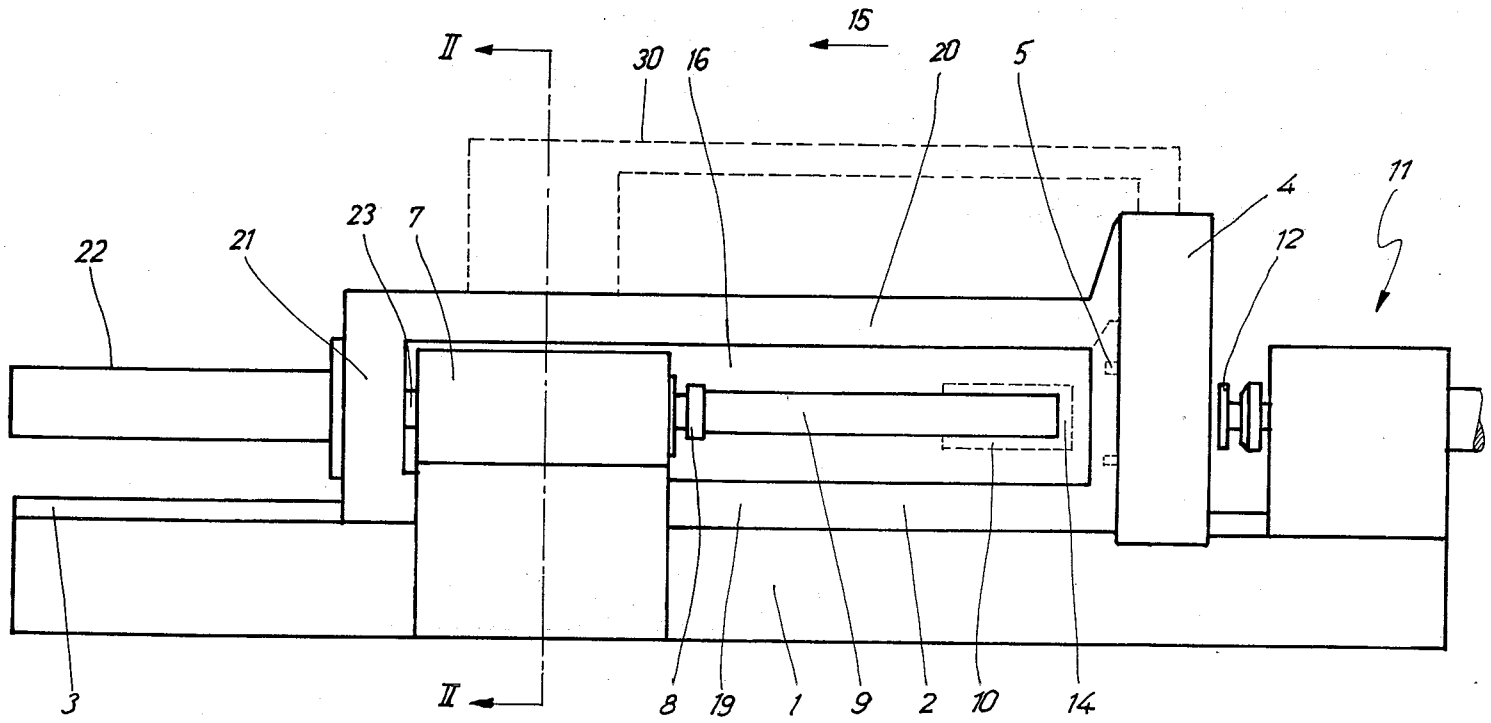
FIG. 1 is a side view of a machine according to the invention.
Figure 2:
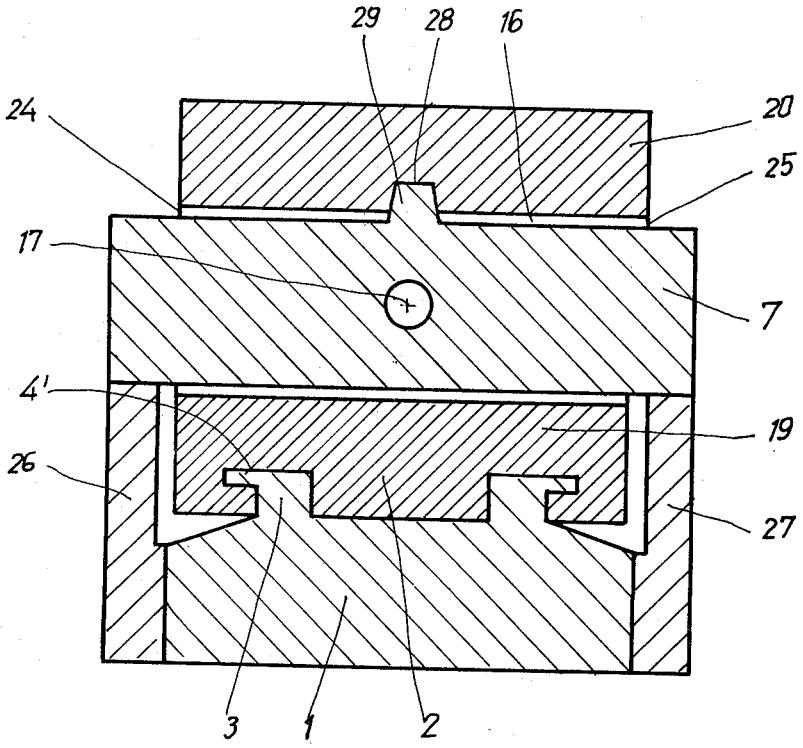
FIG. 2 is a cross-sectional view of the machine according to FIG. 1 as taken along line II—II of FIG. 1.

In order to be able to connect the headstock 7, which is in the recess 16 of the roller head carrier 2, to the base 1, the roller head carrier 2, or its recess 16, is open laterally, as can be seen from FIGS. 1 and 2. The headstock 7 is connected to the base 1, through said lateral openings 24, 25 of the roller head carrier 2, by projecting the headstock laterally beyond the roller head carrier (see FIG. 2) and being fixedly connected to cheeks 26, 27, which extend past the first frame element 19 of the roller head carrier 2 and in turn are fixedly connected to the base 1. The first frame element 19 of the movable roller head carrier 2 is thus surrounded by the headstock 7, the two lateral cheeks 26, 27 and the base 1.

In the above-described machine only centrally directed forces occur, wherein the two horizontal frame elements 19, 20 of the roller head carrier act so to speak as equally loaded draw rods, which pull the roller head 4 over the workpiece. Tilting moments therefor are not applied to the roller head carrier 2 and the base is relieved of tilting forces.

The rollers which are mounted on the roller pins 5 on the roller head 4 apply axially directed forces to the workpiece 10, the resultant of which lies in the center axis 18, because of the circumferentially even distribution of the rollers. The shaping rollers, however, additionally apply a torsion moment onto the rotating workpiece 10 and thus onto the headstock 7. Said torsion moment is received by the fixed connection between the headstock 7 and the two lateral cheeks 26, 27. In order to further improve this absorption of the torsion moment, the headstock 7 can also be supported fixed against rotation on the roller head carrier 2, for example with the help of a wedge guideway. To provide this in the illustrated exemplary embodiment, the headstock 7 has on its upper side, which faces the second frame element 20, a guide piece 29 which engages a guide groove 28 on the second frame part 20.

The headstock 7 is positioned fixedly on the base 1 in the described exemplary embodiment, while the roller head carrier 2 is supported movably. It is now also conceivable, that the relative movement between headstock 7 and roller head carrier 2 can be achieved by instead arranging the roller head carrier fixedly on the base and supporting the headstock movably on the base.

Finally it must be mentioned that the recess 16 is longer than the headstock 7 by approximately the length of the tool 9, such that in the initial position of the machine, when the roller head 4 is moved all the way forwardly, against the direction of the arrow 15, the roller head 4 is spaced from the adjacent end of the tool 9. Reference numeral 30 identifies a copying arrangement which is indicated by dashes.

In the foregoing and in the claims the broad term "forming" is used for the treatment of the workpieces. Herewith is meant more exactly a spinning-operation or a stretching operation. With these operations the shape of a rotationally symmetrical workpiece can be changed without altering the wall thickness or with a reduction of the wall thickness of the workpiece, whereby rollers engage the workpiece, which is moved relative to the rollers in axial direction.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a machine for spinning or stretching of rotationally symmetrical workpieces, comprising a base on which is mounted a roller head carrier for a multi-roller head having plural shaping rolles which are angularly spaced from each other, a headstock supporting a tool for shaping a workpiece and a pressing tail spindle for a counterholder operatively supporting said workpiece, drive means for effecting a relative movement between said roller head carrier and said headstock for effecting a relative movement between said shaping rollers and said workpiece, one of said roller head carrier and said headstock being fixedly connected to said base and the other of said roller head carrier and said headstock being movably connected to said base, the improvement comprising wherein said roller head carrier has a frame-like construction with two horizontal frame elements which are elongated in a longitudinal direction of said machine, a first of said frame elements facing said base and being arranged on said base, a second of said frame elements being spaced from said first frame element, said headstock being located between said two frame elements, said frame elements projecting from the side of said roller head facing said headstock, a recess which extends in the longitudinal direction of said machine, said headstock being arranged in said recess, wherein said two frame elements are fixedly connected to one another at their ends remote from said roller head through a vertical frame element which closes said recess, wherein said drive means on its one side engages said headstock by extending through a hole in said vertical frame and on its other side engages said vertical frame element, the axes of said roller head, said headstock and said drive means coinciding.

2. A machine according to claim 1, wherein drive means is formed by a hydraulic piston-cylinder-assembly, the cylinder of which is connected to said vertical frame and said piston rod is connected to the headstock.

3. A machine according to claim 1, wherein drive is a hydromechanical drive means with a hydraulic motor, a gearing and a spindle, for example a ball roller spindle.

4. A machine according to claim 1, wherein said recess is approximately the length of said tool longer than the headstock, such that in said initial position of said machine said roller head is spaced from the opposed end of said tool.

5. A machine according to claim 1, wherein said recess in said roller head carrier is laterally open and said headstock extends out of said recess through the lateral openings and connects to said base.

6. A machine according to claim 5, wherein said headstock projects laterally beyond said roller head carrier and is connected fixedly to said base through cheeks, which extend past said first frame element of said roller head carrier, said first frame element being guided slidably on said base for guiding said roller head carrier movably on said base.

7. A machine according to claim 1, wherein said two horizontal frame elements and said headstock are plate-like with a substantially rectangular cross section.

8. A machine according to claim 1, wherein said headstock is fixed against rotation with respect to said roller head carrier by a wedge guideway.

9. A machine according to claim 8, wherein said headstock has on its upper side, which faces said second frame element, a guide piece which engages a guide groove on said second frame element, said guide piece and guide groove defining said wedge guideway.

* * * * *

UNITED STATES PATENT AND TRADEMARK OFFICE

CERTIFICATE OF CORRECTION

PATENT NO. : 4 322 960

DATED : April 6, 1982

INVENTOR(S) : Walther Bosch

It is certified that error appears in the above—identified patent and that said Letters Patent is hereby corrected as shown below:

Col. 5, line 39; change "rolles" to ---rollers---.

Col. 6, line 22; change "drive" to ---drive means---.

Col. 6, line 23; change "drive means" to ---drive---.

Col. 6, line 27; change "the" to ---said---.

Col. 6, line 27; change "said" to ---the---.

Signed and Sealed this

*Twentieth* Day of *July 1982*

[SEAL]

*Attest:*

GERALD J. MOSSINGHOFF

*Attesting Officer*

*Commissioner of Patents and Trademarks*